US009964007B2

(12) United States Patent
Kim et al.

(10) Patent No.: US 9,964,007 B2
(45) Date of Patent: May 8, 2018

(54) VARIABLE VALVE DURATION/VARIABLE VALVE LIFT SYSTEM AND ENGINE PROVIDED WITH THE SAME

(71) Applicant: Hyundai Motor Company, Seoul (KR)

(72) Inventors: Kyung Mo Kim, Gyeonggi-do (KR); Seock Joong Yoon, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 130 days.

(21) Appl. No.: 15/267,871

(22) Filed: Sep. 16, 2016

(65) Prior Publication Data

US 2017/0167319 A1 Jun. 15, 2017

(30) Foreign Application Priority Data

Dec. 11, 2015 (KR) ..... 10-2015-0177476

(51) Int. Cl.

| | |
|---|---|
| ***F01L 1/34*** | (2006.01) |
| ***F01L 13/00*** | (2006.01) |
| ***F01L 1/053*** | (2006.01) |
| ***F01L 1/26*** | (2006.01) |
| ***F01L 1/18*** | (2006.01) |
| *F01L 1/46* | (2006.01) |
| *F01L 1/356* | (2006.01) |
| *F01L 1/047* | (2006.01) |

(52) U.S. Cl.

CPC ..... *F01L 13/0015* (2013.01); *F01L 1/053* (2013.01); *F01L 1/181* (2013.01); *F01L 1/267* (2013.01); *F01L 1/356* (2013.01); *F01L 2001/0473* (2013.01); *F01L 2001/0535* (2013.01); *F01L 2001/467* (2013.01); *F01L 2013/001* (2013.01); *F01L 2013/105* (2013.01); *F01L 2105/00* (2013.01)

(58) Field of Classification Search

CPC . F01L 1/053; F01L 1/181; F01L 1/267; F01L 13/0015; F01L 2001/0473; F01L 2001/467

USPC ..... 123/90.12, 90.16, 90.39, 90.44

See application file for complete search history.

(56) References Cited

U.S. PATENT DOCUMENTS 9,574,467 B2 * 2/2017 Ha ..... F01L 13/0015 123/90.16

FOREIGN PATENT DOCUMENTS

| | | |
|---|---|---|
| JP | 2009-236010 A | 10/2009 |
| JP | 2015-117692 A | 6/2015 |

* cited by examiner

*Primary Examiner* — Ching Chang

(74) *Attorney, Agent, or Firm* — Brinks Gilson & Lione

(57) ABSTRACT

The present disclosure provides a variable valve duration/variable valve lift system including a camshaft in a first cam with a variable relative phase angle with respect to the camshaft, an inner bracket transmitting rotation of the camshaft, a slider housing, a first rocker arm of which a first end contacts the first cam, a rocker shaft connected to the first rocker arm on which hydraulic lines are formed, solenoid valves configured to selectively supply hydraulic pressure through the hydraulic lines, a position controller configured to selectively change a position of the slider housing according to supplied hydraulic pressure from the solenoid valves, a first bridge connected to a second end of the first rocker arm and to which a first valve is connected, and a first valve lift device disposed within the first bridge for changing valve lift of the first valve according to supplied hydraulic pressure from hydraulic lines.

22 Claims, 14 Drawing Sheets

VARIABLE VALVE DURATION/VARIABLE VALVE LIFT SYSTEM AND ENGINE PROVIDED WITH THE SAME

CROSS-REFERENCE TO RELATED APPLICATION

This application claims priority to and the benefit of Korean Patent Application No. 10-2015-0177476, filed on Dec. 11, 2015, the entire contents of which are incorporated herein by reference.

FIELD

The present disclosure relates to a variable valve duration/variable valve lift system and an engine provided with the same.

BACKGROUND

The statements in this section merely provide background information related to the present disclosure and may not constitute prior art.

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, research, such as designing of a plurality of cams and a continuous variable valve lift (CVVL) that can change valve lift according to engine speed, has been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

The above information disclosed in this Background section is only for enhancement of understanding of the background of the disclosure and therefore it may contain information that does not form the prior art that is already known to a person of ordinary skill in the art.

Further areas of applicability will become apparent from the description provided herein. It should be understood that the description and specific examples are intended for purposes of illustration only and are not intended to limit the scope of the present disclosure.

SUMMARY

The present disclosure provides a variable valve duration/variable valve lift system and an engine provided with the same which may vary opening duration and lift of a valve according to operation conditions of an engine, with a simple construction.

A variable valve duration/variable valve lift system according to various aspects of the present disclosure may be applied to a Single Over Head Cam (SOHC) engine so as to reduce weight of the engine and driving resistance.

According to various aspects of the present disclosure, a variable valve duration/variable valve lift system may include a camshaft, a first cam portion including a first cam, into which the camshaft is inserted and of which a relative phase angle of the first cam with respect to the camshaft is variable, an inner bracket transmitting rotation of the camshaft to the first cam portion, a slider housing in which the inner bracket is rotatably inserted, a first rocker arm of which a first end contacts the first cam, a rocker shaft to which the first rocker arm is rotatably connected on which a first control hydraulic line and a second control hydraulic line are formed, a first solenoid valve configured to selectively supply hydraulic pressure through the first control hydraulic line, a second solenoid valve configured to selectively supply hydraulic pressure through the second control hydraulic line, a position controller configured to selectively change a position of the slider housing according to supplied hydraulic pressure from the first solenoid valve, a first bridge connected to a second end of the first rocker arm and to which a first valve is connected and a first valve lift device disposed within the first bridge for changing valve lift of the first valve according to supplied hydraulic pressure from the second control hydraulic line.

The position controller may include a controller housing on which a master valve hole is formed. A master valve is inserted into the master valve hole and moved according to supplied hydraulic pressure from the solenoid valve so as to change a relative position of the slider housing with respect to the camshaft.

A lock pin hole may be formed in the controller housing, wherein the position controller may further include a lock pin disposed within the lock pin hole and selectively connected to the master valve according to supplied hydraulic pressure from the first solenoid valve and a return spring disposed within the lock pin hole and elastically supporting the lock pin.

A valve groove into which the lock pin is selectively inserted may be formed in the master valve.

The controller housing may be mounted for supporting the rocker shaft.

The first valve lift device may include a screw on which a screw oil hole connected to the first rocker arm, a plunger slidable within the first bridge and on which a plunger oil hole in communication with the screw oil hole is formed, a plunger lock pin slidable within the first bridge and selectively connected to the plunger according to supplied hydraulic pressure from the plunger oil hole, a plunger return spring disposed within the first bridge and pushing the plunger lock pin for the plunger lock pin to be connected to the plunger, a lost motion spring disposed within the first bridge and elastically supporting the plunger, and a swivel foot connecting the plunger with the screw.

A first slot and a second slot may be formed in the inner bracket, and the first cam portion may include a wheel on which a wheel key is formed and connected to the first cam. The variable valve duration/variable valve lift system may further include a connecting pin connected to the camshaft, a first slider pin on which a pin slot is formed and into which the wheel key is slidably inserted along a length direction of the wheel key, and a second slider pin on which a pin hole is formed in which the connecting pin is slidably inserted along a length direction of the connecting pin. The first slider pin is rotatably inserted into the first slot and the second slider pin is rotatably inserted into the second slot.

The variable valve duration/variable valve lift system may further include a bearing disposed between the slider housing and the inner bracket.

The variable valve duration/variable valve lift system may further include a first roller connected to a first end of the first rocker arm and contacting the first cam and a first bridge connected to a second end of the first rocker arm, wherein the first valve may be connected to the first bridge as a pair.

The variable valve duration/variable valve lift system may further include an outer shaft on which a guide slot is formed and to which the camshaft is inserted, and wherein the first cam may be connected to the outer shaft.

The variable valve duration/variable valve lift system may further include a second cam portion including a second cam connected to the camshaft through the guide slot and a second rocker arm rotatably connected to the rocker shaft, a first end of which contacts the second cam and a second end of which is connected with a second valve.

The variable valve duration/variable valve lift system may further include a second roller connected to a first end of the second rocker arm and contacting the second cam and a second bridge connected to a second end of the second rocker arm, and wherein the second valve may be connected to the second bridge as a pair.

The variable valve duration/variable valve lift system may further include a second roller connected to a first end of the second rocker arm and contacting the second cam, a second bridge connected to a second end of the second rocker arm and a second valve lift device disposed within the second bridge for changing valve lift of the second valve according to supplied hydraulic pressure from the second control hydraulic line.

The second valve lift device may include a screw on which a screw oil hole connected to the second rocker arm, a plunger slidable within the second bridge and on which a plunger oil hole in communication with the screw oil hole is formed, a plunger lock pin slidable within the second bridge and selectively connected to the plunger according to supplied hydraulic pressure from the plunger oil hole, a plunger return spring disposed within the second bridge pushing the plunger lock pin to be connected to the plunger, a lost motion spring disposed within the second bridge and elastically supporting the plunger, and a swivel foot connecting the plunger with the screw.

According to various aspects of the present disclosure, and engine may include a camshaft, a first cam portion including a first cam, into which the camshaft is inserted and of which a relative phase angle of the first cam with respect to the camshaft is variable, an inner bracket transmitting rotation of the camshaft to the first cam portion, a slider housing in which the inner bracket is rotatably inserted, a first rocker arm of which a first end contacts the first cam, a rocker shaft to which the first rocker arm is rotatably connected on which a first control hydraulic line and a second control hydraulic line are formed, a first solenoid valve configured to selectively supply hydraulic pressure through the first control hydraulic line, a second solenoid valve configured to selectively supply hydraulic pressure through the second control hydraulic line, a position controller configured to selectively change a position of the slider housing according to supplied hydraulic pressure from the first solenoid valve, a first bridge connected to a second end of the first rocker arm and to which a first valve is connected and a first valve lift device disposed within the first bridge for changing valve lift of the first valve according to supplied hydraulic pressure from the second control hydraulic line.

The first valve lift device may include a screw on which a screw oil hole connected to the first rocker arm, a plunger slidable within the first bridge and on which a plunger oil hole in communication with the screw oil hole is formed, a plunger lock pin slidable within the first bridge and selectively connected to the plunger according to supplied hydraulic pressure from the plunger oil hole, a plunger return spring disposed within the first bridge and pushing the plunger lock pin for the plunger lock pin to be connected to the plunger, a lost motion spring disposed within the first bridge and elastically supporting the plunger and a swivel foot connecting the plunger with the screw.

The position controller may include a controller housing on which a master valve hole is formed, a master valve inserted into the master valve hole and moved according to supplied hydraulic pressure from the solenoid valve so as to change a relative position of the slider housing with respect to the camshaft, a lock pin disposed within the lock pin hole and selectively connected to the master valve according to supplied hydraulic pressure from the first solenoid valve, and a return spring disposed within the lock pin hole and elastically supporting the lock pin.

A first slot and a second slot may be formed to the inner bracket, the first cam portion comprises a wheel on which a wheel key is formed and connected to the first cam, and wherein the variable valve duration/variable valve lift system may further include a connecting pin connected to the camshaft, a first slider pin on which a pin slot where the wheel key is slidably inserted thereto along a length direction of the wheel key is formed and the first slider pin rotatably inserted into the first slot and a second slider pin on which a pin hole where the connecting pin is slidably inserted thereto along a length direction of the connecting pin is formed and the second slider pin rotatably inserted into the second slot.

The engine may further include an outer shaft on which a guide slot is formed and to which the camshaft is inserted, and wherein the first cam may be connected to the outer shaft.

The engine may further include a second cam portion including a second cam connected to the camshaft through the guide slot and a second rocker arm rotatably connected to the rocker shaft, a first end of which contacts the second cam and a second end of which is connected with a second valve.

The engine may further include a second roller connected to a first end of the second rocker arm and contacting the second cam, a second bridge connected to a second end of the second rocker arm, and a second valve lift device disposed within the second bridge for changing valve lift of the second valve according to supplied hydraulic pressure from the second control hydraulic line.

The second valve lift device may include a screw on which a screw oil hole connected to the second rocker arm, a plunger slidable within the second bridge and on which a plunger oil hole in communication with the screw oil hole is formed, a plunger lock pin slidable within the second bridge and selectively connected to the plunger according to supplied hydraulic pressure from the plunger oil hole, a plunger return spring disposed within the second bridge and pushing the plunger lock pin for the plunger lock pin to be connected to the plunger, a lost motion spring disposed within the second bridge and elastically supporting the plunger, and a swivel foot connecting the plunger with the screw.

As described above, the variable valve duration/variable valve lift system according to one form of the present disclosure may vary an opening duration of a valve as well as valve lift according to operation conditions of an engine, with a simple construction.

The variable valve duration/variable valve lift system of the present disclosure may be reduced in size and thus the entire height of a valve train may be reduced.

The variable valve duration/variable valve lift system may be applied to an existing engine without excessive modification, thus productivity may be enhanced and production costs may be reduced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
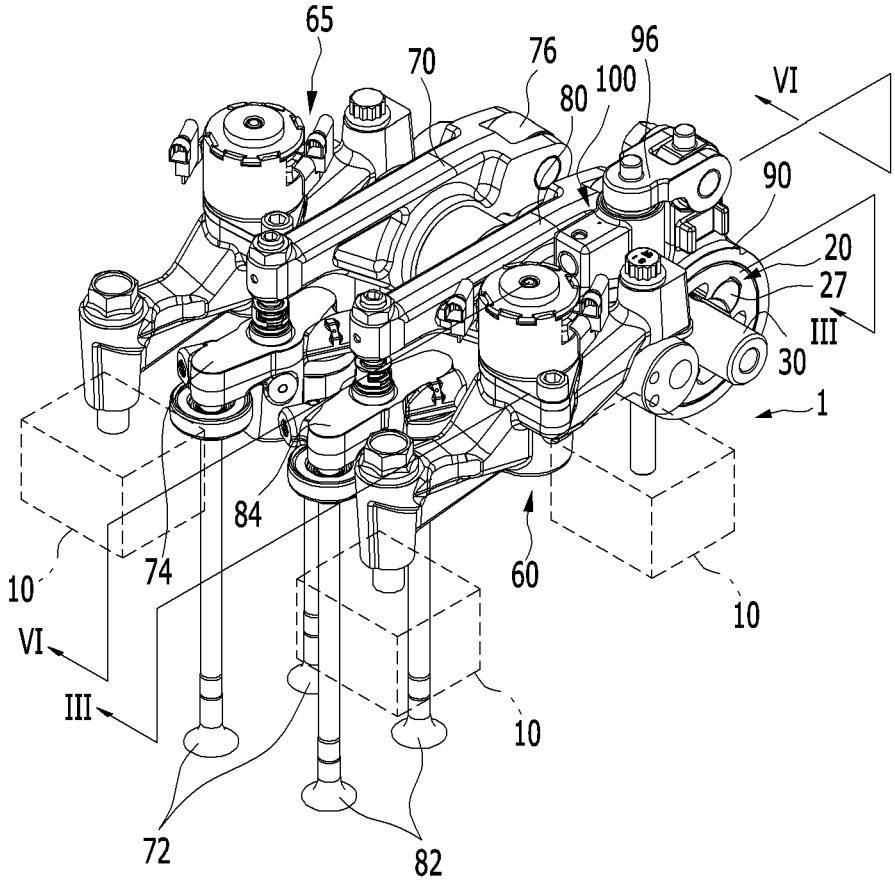
FIG. 1 is a perspective view of an engine provided with a variable valve duration/variable valve lift system according to the present disclosure.

The drawings described herein are for illustration purposes only and are not intended to limit the scope of the present disclosure in any way.

| <Description of symbols> | |
|---|---|
| 1: engine | 10: cylinder head |
| 20: inner bracket | 22: first slot |
| 24: second slot | 25: first slider pin |
| 26: pin slot | 27: second slider pin |
| 28: pin hole | 30: camshaft |
| 32: camshaft hole | 40: first cam portion |
| 42: first cam | 43: cam hole |
| 44: wheel | 46: wheel key |

-continued

| <Description of symbols> | |
|---|---|
| 48: cam pin | 50: second cam portion |
| 52: second cam | 54: connection pin |
| 60: first solenoid valve | 65: second solenoid valve |
| 70: first rocker arm | 72: first valve |
| 74: first bridge | 76: first roller |
| 78: rocker arm control hydraulic line | 80: second rocker arm |
| 82: second valve | 84: second bridge |
| 86: second roller | 88: rocker arm control hydraulic line |
| 90: slider housing | 94: bearing |
| 96: connecting bracket | 100: position controller |
| 101: controller housing | 102: master valve hole |
| 103: master valve | 104: valve groove |
| 105: lock pin hole | 106: lock pin |
| 107: return spring | 108: master valve hydraulic line |
| 109: lock pin hydraulic line | 110: rocker shaft |
| 112: first control hydraulic line | 113: second control hydraulic line |
| 114: lubrication hydraulic line | 120: outer shaft |
| 122: guide slot | 130: upper bracket |
| 132: stopper | 140: first valve lift device |
| 142: screw | 144: screw oil hole |
| 146: plunger | 148: plunger oil hole |
| 150: plunger lock pin | 152: plunger return spring |
| 154: lost motion spring | 156: swivel foot |
| 160: second valve lift device | |

DETAILED DESCRIPTION

The following description is merely exemplary in nature and is not intended to limit the present disclosure, application, or uses. It should be understood that throughout the drawings, corresponding reference numerals indicate like or corresponding parts and features.

As those skilled in the art would realize, the described forms may be modified in various different ways, all without departing from the spirit or scope of the present disclosure A part irrelevant to the description will be omitted to clearly describe the present disclosure, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

Figure 2:
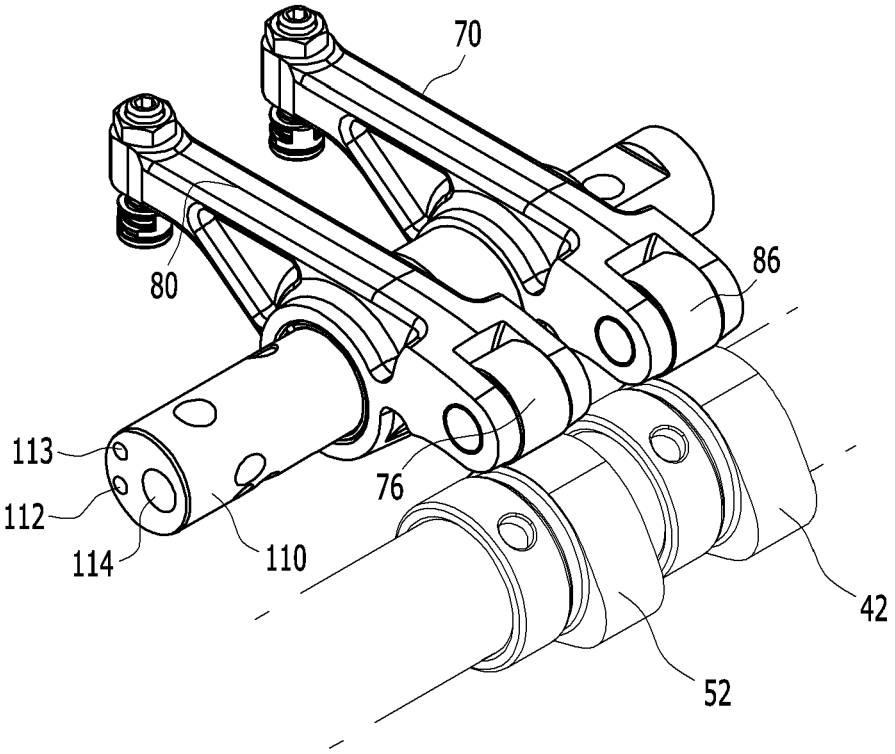
FIG. 2 is a partial perspective view of a variable valve duration/variable valve lift system according to the present disclosure.

FIG. 1 is a perspective view of an engine provided with a variable valve duration/variable valve lift system according to the present disclosure and FIG. 2 is a partial perspective view of a variable valve duration/variable valve lift system according to the present disclosure.

Figure 3:
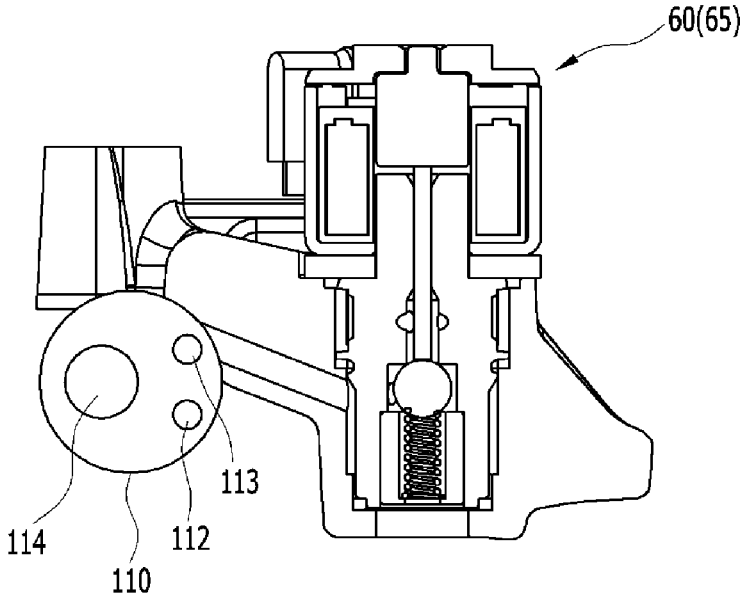
FIG. 3 is a cross-sectional view along line III-III of FIG. 1.
Figure 4:
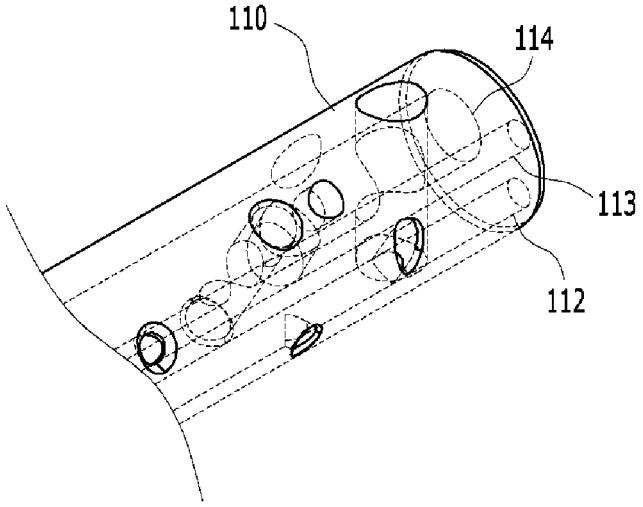
FIG. 4 is a drawing showing a rocker shaft of a variable valve duration/variable valve lift system according to the present disclosure.

FIG. 3 is a cross-sectional view along line III-III of FIG. 1 and FIG. 4 is a drawing showing a rocker shaft of a variable valve duration/variable valve lift system according to the present disclosure.

Figure 5:
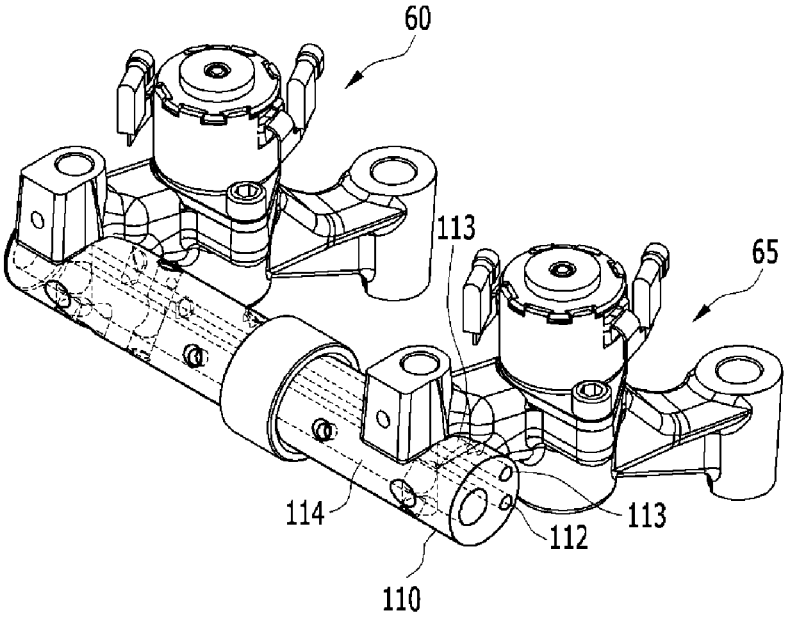
FIG. 5 is a drawing showing a solenoid valve of a variable valve duration/variable valve lift system according to the present disclosure.
Figure 6:
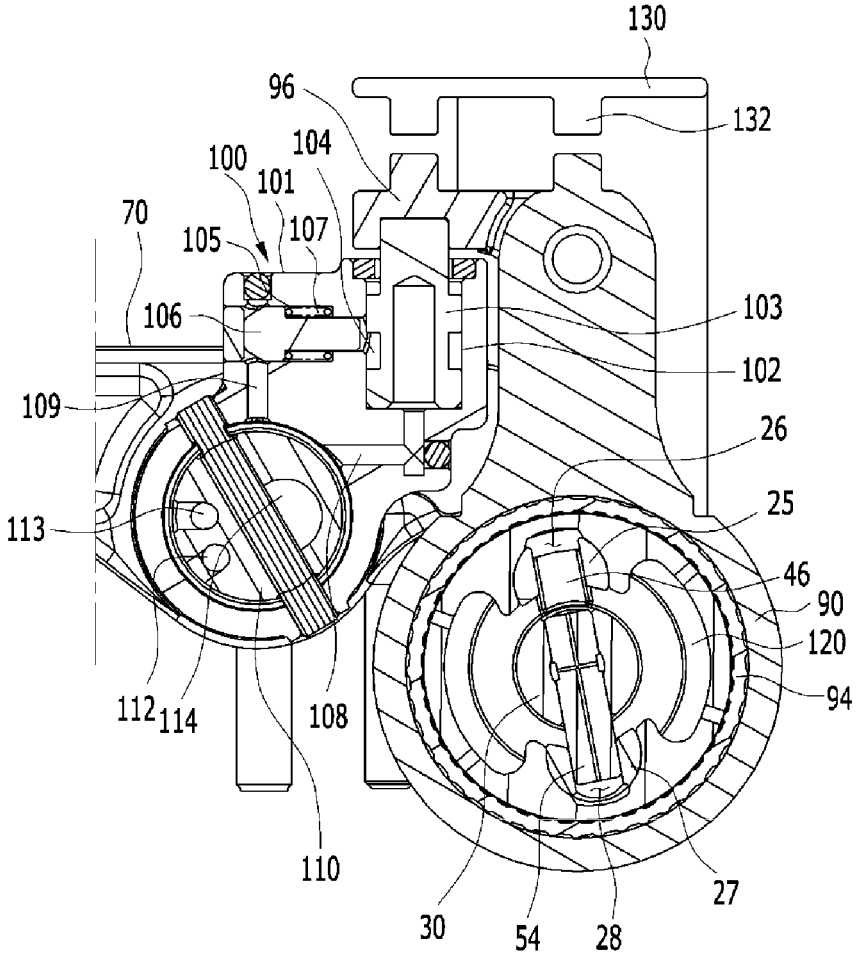
FIG. 6 and FIG. 7 are cross-sectional views along line VI-VI of FIG. 1.
Figure 7:
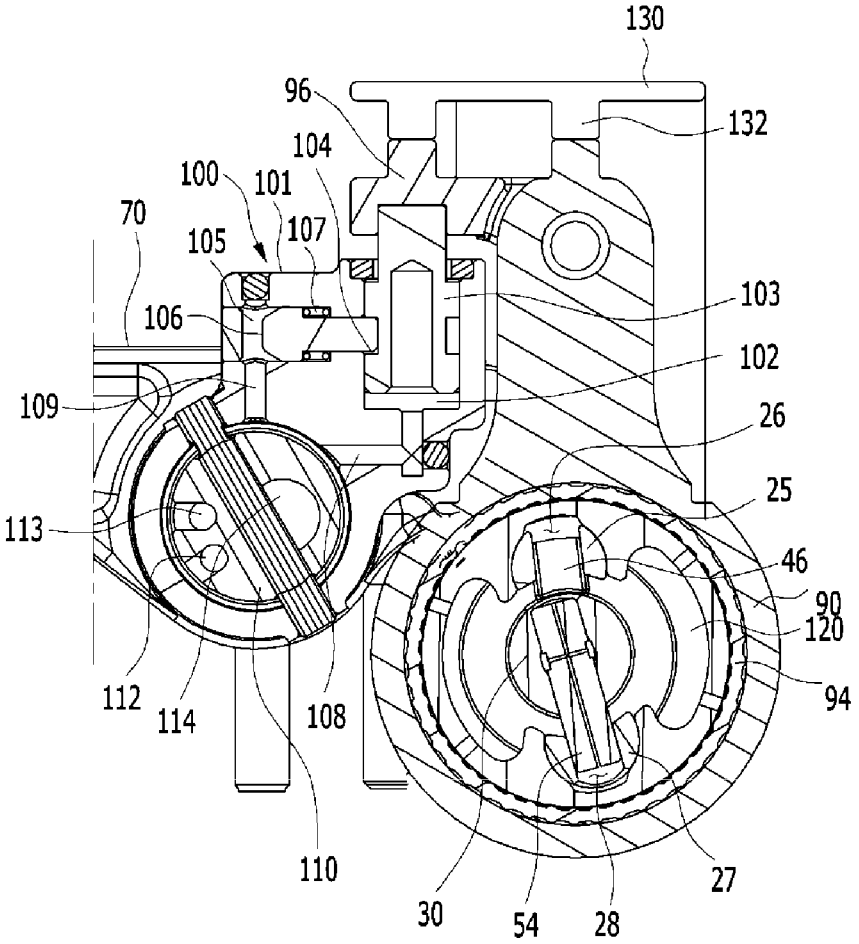

FIG. 5 is a drawing showing a solenoid valve of a variable valve duration/variable valve lift system according to the present disclosure and FIG. 6 and FIG. 7 are cross-sectional views along line VI-VI of FIG. 1.

Figure 8:
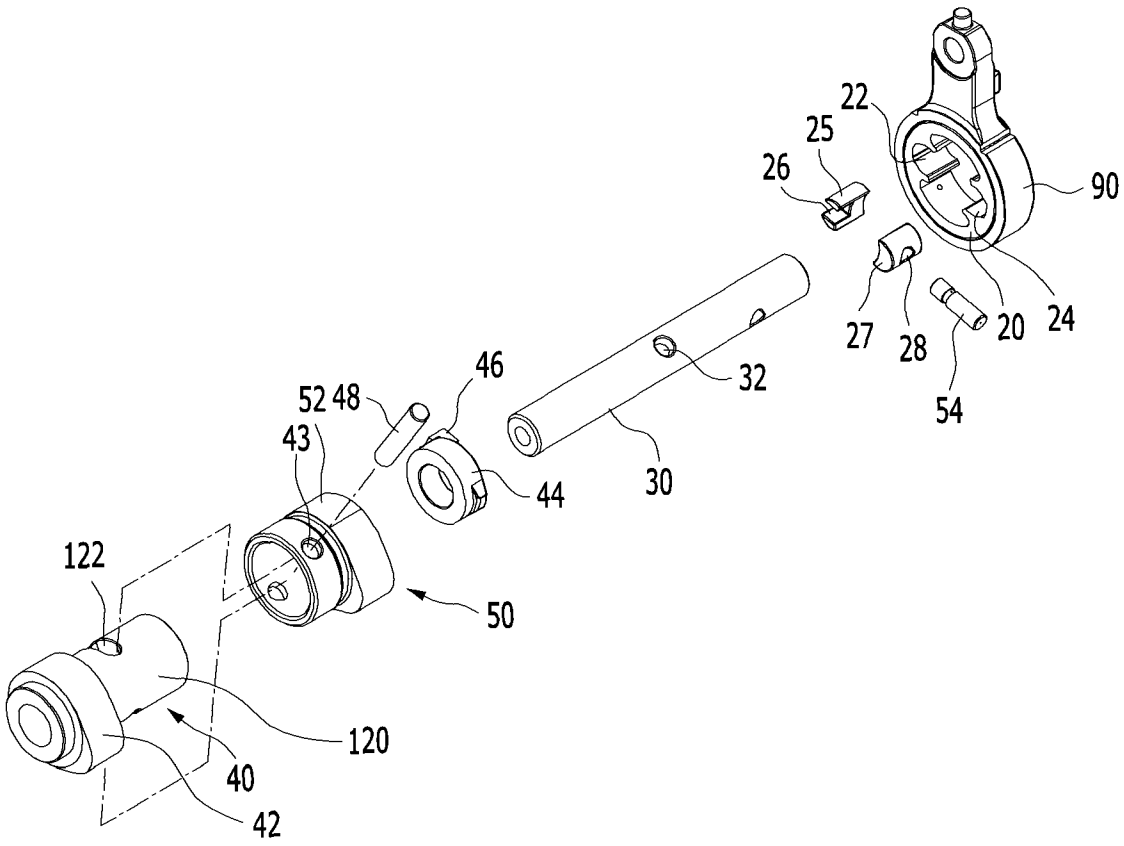
FIG. 8 is a partial exploded perspective view of a variable valve duration/variable valve lift system according to the present disclosure.

FIG. 8 is a partial exploded perspective view of a variable valve duration/variable valve lift system according to the present disclosure.

Referring to FIG. 1 to FIG. 8, an engine 10 according to a form of the present disclosure includes a cylinder head 10 and a variable valve duration/variable valve lift system mounted to the cylinder head 10.

The variable valve duration/variable valve lift system may include a camshaft 30, a first cam portion 40 including a first cam 42, into which the camshaft 30 is inserted and of which a relative phase angle of the first cam 42 with respect to the camshaft 30 is variable, an inner bracket 20 transmitting rotation of the camshaft 30 to the first cam portion 40, a slider housing 90 in which the inner bracket 20 is rotatably inserted, a first rocker arm 70 of which a first end contacts the first cam 42, a rocker shaft 110 to which the first rocker arm 70 is rotatably connected and on which a first control hydraulic line 112 and a second control hydraulic line 113 are formed, a first solenoid valve 60 configured to selectively supply hydraulic pressure through the first control hydraulic line 112, a second solenoid valve 65 configured to selectively supply hydraulic pressure through the second control hydraulic line 113, a position controller 100 configured to selectively change a position of the slider housing 90 according to supplied hydraulic pressure from the first solenoid valve 60, a first bridge 74 connected to a second end of the first rocker arm 70 and to which a first valve 72 is connected, and a first valve lift device 140 disposed within the first bridge 74 for changing valve lift of the first valve 72 according to supplied hydraulic pressure from the second control hydraulic line 113.

According to the present disclosure, the cylinder head 10 may include a cam carrier.

Also, a lubrication hydraulic line 114 for supplying lubricant may be formed to the rocker shaft 110.

The position controller 100 includes a controller housing 101 on which a master valve hole 102 is formed. A master valve 103 is inserted into the master valve hole 102 and moved according to supplied hydraulic pressure from the first solenoid valve 60 so as to change a relative position of the slider housing 90 with respect to the camshaft 30.

The master valve 103 and the slider housing 90 may be connected through a connecting bracket 96.

A lock pin hole 105 is formed to the controller housing 101. The position controller 100 includes a lock pin 106 disposed within the lock pin hole 105 which is selectively connected to the master valve 103 according to supplied hydraulic pressure from the solenoid valve 60. A return spring 107 is disposed within the lock pin hole 105 and elastically supports the lock pin 106.

The lock pin 106 is selectively inserted into a valve groove 104 formed to the master valve 103.

A master valve hydraulic line 108 and a lock pin hydraulic line 109 are formed to the controller housing 101 in fluid communication with the valve hole 102 and the lock pin hole 106 respectively.

The rocker shaft 110 is inserted into the controller housing 101 and the controller housing 101 supports and mounts the rocker shaft 110 to the cylinder head 10.

In various forms, the engine 1 further includes an upper bracket 130 connecting the camshaft 30 to the cylinder head 10 together with the cam cap 12. A stopper 132 for limiting movement of the slider housing 90 is formed to the upper bracket 130.

A first slot 22 and a second slot 24 are formed to the inner bracket 20.

The first cam portion 40 includes a wheel 44 on which a wheel key 46 is formed and connected to the first cam 42.

A camshaft hole 32 is formed in the camshaft 30 and a connection pin 54 is connected to the cam shaft 30 through the camshaft hole 32.

A first slider pin 25, on which a pin slot 26 is formed, is rotatably inserted into the first slot 22. The wheel key 46 is slidably inserted into the pin slot along a length direction of the wheel key 46. And a second slider pin 27, on which a pin hole 28 is formed, and into which the connecting pin 54 is slidably inserted along a length direction of the connecting pin, is rotatably inserted into the second slot 24.

A bearing 94 is disposed between the slider housing 90 and the inner bracket 20. Thus, rotation of the inner bracket 20 may be easily performed.

The variable valve duration/variable valve lift system according to one form of the present disclosure further includes a second cam portion 50 including a second cam 52 rotating with the same phase angle of the camshaft 30 and a second rocker arm 80 rotatably connected to the rocker shaft 110, of which an end contacts with the second cam 52 and of which the other end is connected with a second valve 82.

The camshaft 30 may be inserted into an outer shaft 120 where a guide slot 122 may be formed along a circumference direction thereof, and the wheel 44 is connected to the outer shaft 120. The first cam 42 is connected to and rotated with the outer shaft 120.

A cam pin 48 may be connected to the second cam 52 and the cam pin 48 is inserted into the guide slot 122 for guiding rotation of the second cam 52. A cam hole 43 may be formed to the second cam 52, the cam pin 48 is connected to the cam hole 43 and the cam pin 48 may be movably inserted into the guide slot 122. Thus the second cam 52 may relatively rotate with respect to the outer shaft 120 along a circumference direction of the outer shaft 120.

A first roller 76 contacting the first cam 42 is connected to a first end of the first rocker arm 70 and a first bridge 74 is connected to a second end of the first rocker arm 70.

The first valve 72 may be connected to the first bridge 74 as a pair.

A second roller 86 contacting the second cam 52 is connected to a first end of the second rocker arm 80 and a second bridge 84 is connected to a second end of the second rocker arm 80.

The second valve 82 may be connected to the second bridge 80 as a pair.

Figure 9:
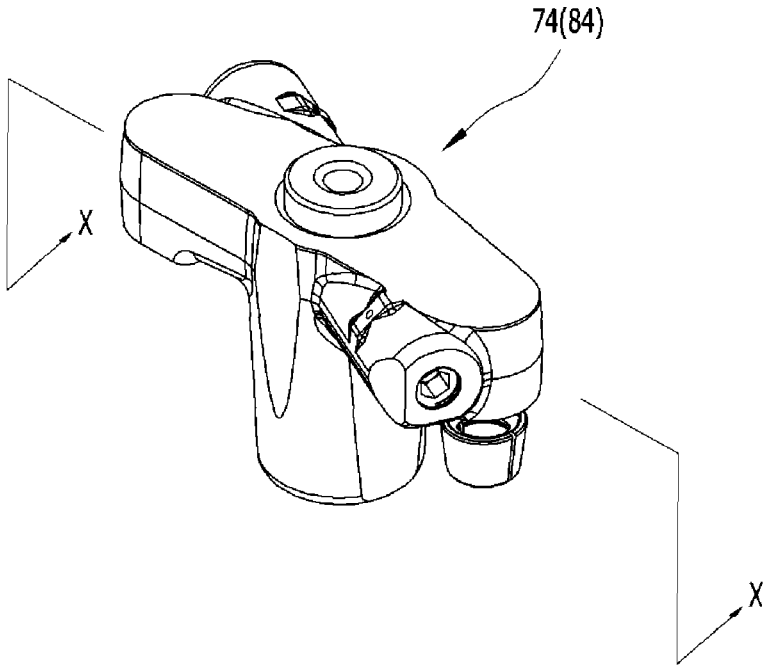
FIG. 9 is a perspective view of a bridge of a variable valve duration/variable valve lift system according to the present disclosure.
Figure 10:
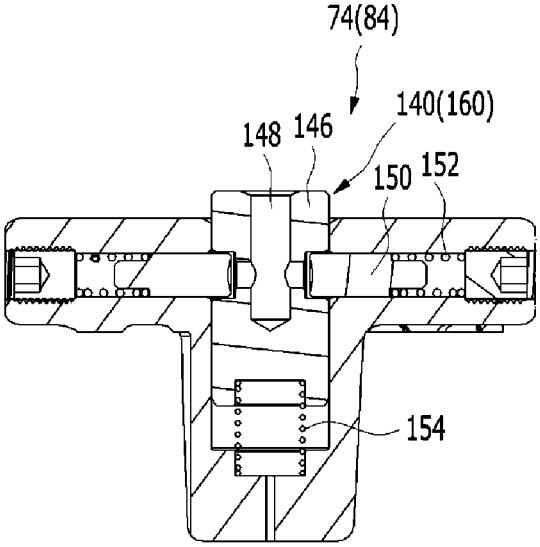
FIG. 10 is a cross-sectional view along line X-X of FIG. 9.
Figure 11:
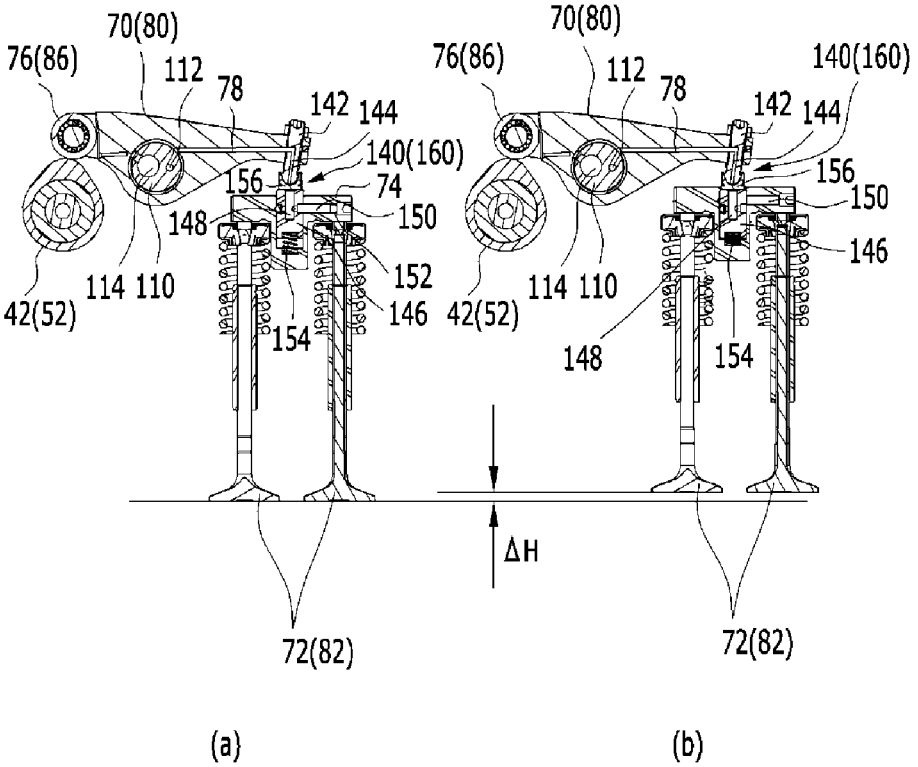
FIG. 11 is a cross-sectional view showing an operation of a variable valve lift apparatus applied to a variable valve duration/variable valve lift system according to the present disclosure.

FIG. 9 is a perspective view of a bridge of one variable valve duration/variable valve lift system according to the present disclosure, FIG. 10 is a cross-sectional view along line X-X of FIG. 9 and FIG. 11 is a cross-sectional view showing an operation of a variable valve lift apparatus applied to one variable valve duration/variable valve lift system according to the present disclosure.

Referring to FIG. 9 to FIG. 11, the first valve lift device 140 includes a screw 142 on which a screw oil hole 144 connected to the first rocker arm 70, a plunger 146 slidable within the first bridge 74 and on which a plunger oil hole 148 in communication with the screw oil hole 144 is formed; a plunger lock pin 150 slidable within the first bridge 74 and selectively connected to the plunger 146 according to supplied hydraulic pressure from the plunger oil hole 148; a plunger return spring 152 disposed within the first bridge 74 and pushing the plunger lock pin 150 to be connected to the plunger 146; a lost motion spring 154 disposed within the first bridge 74 and elastically supporting the plunger 146; and a swivel foot 156 connecting the plunger 146 with the screw 142.

The plunger lock pin 150 may be disposed vertically to the plunger 146. A rocker arm control hydraulic line 78 is formed in the first rocker arm 70 and hydraulic pressure selectively supplied from the second solenoid valve 65 is supplied to the plunger lock pin 150 through the rocker arm control hydraulic line 78.

A valve lift of the first valve 72 is controlled according to supplied hydraulic pressure from the second solenoid valve 65.

In one form of the present disclosure, the variable valve duration/variable valve lift system may further include a second valve lift device 160 disposed within the second bridge 84 to control a valve lift of the second valve 82 according to supplied hydraulic pressure from the second control hydraulic line 113.

A structure of the second valve lift device 160 is the same as the first valve lift device 140 described above, thus repeated description will be omitted.

The variable valve duration/variable valve lift system according to one form of the present disclosure may be applied to a SOHC engine with reduced weight and with reduced driving resistance and may change the duration of the valve and the valve lift.

Hereinafter, referring to the drawings, an operation of the position controller will be described.

When hydraulic pressure is not supplied from the first solenoid valve 60 as shown in FIG. 6, rotation centers of the camshaft 30 and the inner bracket 20 are coincident, and the first cam 42 and the camshaft 30 rotate with the same speed.

When an ECU (electric control unit) outputs a control signal to the first solenoid valve 60, hydraulic pressure from the first solenoid valve 60 is supplied to the master valve 103 through the first control hydraulic line 112 and then the master valve 103 moves together with the slider housing 90.

As shown in FIG. 7, the slider housing 90 moves upward and the rotation centers of the inner bracket 20 and the camshaft 30 are not coincident.

Then the rotation speed of the first cam 42 with respect to the rotation speed of the camshaft 30 is changed.

While the connecting pin 54 is rotated together with the camshaft 30, the connecting pin 54 is movable within the pin hole 28, the second slider pin 27 and the first slider pin 25 are rotatable within the second slot 24 and the first slot 22 respectively and the wheel key 46 is movable within the pin slot 26. Thus when the rotation centers of the camshaft 30 and the inner bracket 20 are not coincident, the rotation speed of the first cam 42 with respect to the rotation speed of the camshaft 30 is changed.

According to the relative position of the inner bracket 20, timing of the first cam 42 to push the first roller 76, that is the timing of the first valve 72, to be opened or closed is changed.

That is, the position controller is operated as a VVD (variable valve duration) apparatus.

Hereinafter, referring to the drawings, an operation of the first valve lift device will described.

When the ECU outputs a control signal to the second solenoid valve 65, hydraulic pressure from the first solenoid valve 60 is supplied to the plunger lock pin 150 through the second control hydraulic line 113, the rocker arm control hydraulic line 78, the screw oil hole 144 and the plunger oil hole 148. Then, the plunger lock pin 150 is disconnected from the plunger 146, the plunger 146 loses motion at $\Delta H$ and then lift of the first valve 72 is changed.

The variable valve duration/variable valve lift system may further include the second valve lift device 160 disposed within the second bridge 84, which is supplied hydraulic pressure from the second control hydraulic line 113 and controls the valve lift of the second valve 82 as well as the first valve 72 simultaneously.

The first valve 72 may be an intake valve and the second valve 82 may be an exhaust valve. The variable valve duration/variable valve lift system may only change the lift of the first valve 72. The variable valve duration/variable valve lift system provided with the second valve lift device 160 may change the lifts of the first valve 72 and the lift of the second valve 82.

Figure 12:
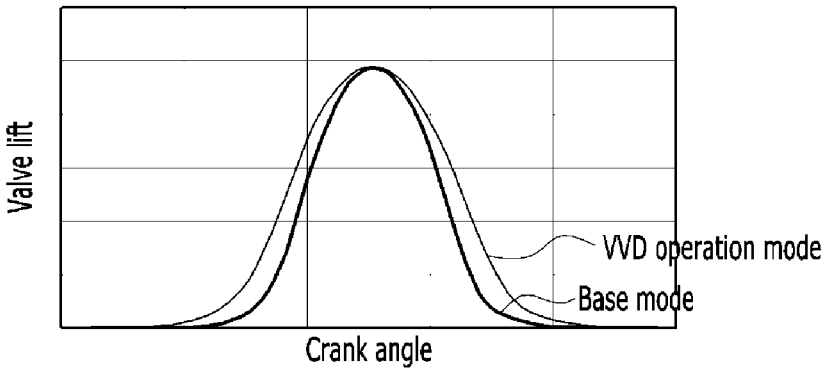
FIG. 12 to FIG. 14 are graphs of a valve profile of a variable valve duration/variable valve lift system according to the present disclosure.
Figure 13:
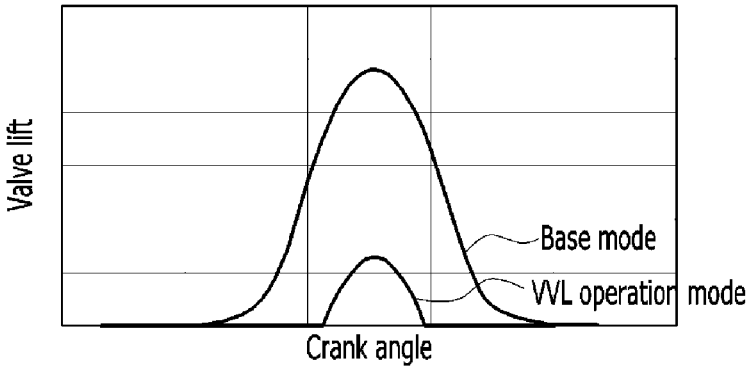
Figure 14:
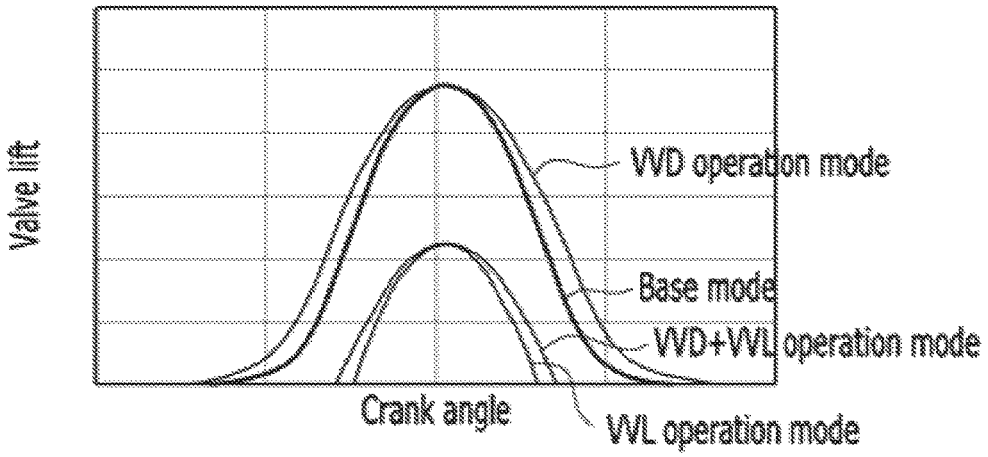

FIG. 12 to FIG. 14 are graphs of a valve profile of a variable valve duration/variable valve lift system according to the present disclosure.

Referring to FIG. 12 to FIG. 14, the variable valve duration/variable valve lift system may change valve duration and valve lift independently according to engine operation conditions.

As shown in FIG. 12, the first solenoid valve 60 may be controlled for the engine to be operated as a base mode and a VVD mode, and as shown in FIG. 13, the second solenoid valve 65 may be controlled for the engine to be operated as the base mode and a VVL mode.

That is, the first solenoid valve 60 and the second solenoid valve 65 may be operated independently.

As shown in FIG. 14, the engine may be operated as the base mode and the VVD mode by the only operation of the first solenoid valve 60. The engine may be operated as the base mode and the VVL mode by the operation of only the second solenoid valve 65. Also, the engine may be operated as a VVD+VVL mode by the operations of the first solenoid valve 60 and the second solenoid valve 65 simultaneously.

As described above, the variable valve duration/variable valve lift system according to one form of the present disclosure may vary an opening duration of a valve as well as valve lift simultaneously according to operation conditions of an engine, with a simple construction.

The variable valve duration/variable valve lift system according to one form of the present disclosure may be reduced in size and thus the entire height of a valve train may be reduced.

The variable valve duration/variable valve lift system may be applied to an existing engine without excessive modification, thus productivity may be enhanced and production costs may be reduced.

While this disclosure has been described in connection with what is presently considered to be practical forms, it is to be understood that the disclosure is not limited to the disclosed forms. On the contrary, it is intended to cover various modifications and equivalent arrangements included within the spirit and scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A variable valve duration/variable valve lift system comprising:

a camshaft;

a first cam portion including a first cam, into which the camshaft is inserted and of which a relative phase angle of the first cam with respect to the camshaft is variable;

an inner bracket transmitting rotation of the camshaft to the first cam portion;

a slider housing in which the inner bracket is rotatably inserted;

a first rocker arm of which a first end contacts the first cam;

a rocker shaft to which the first rocker arm is rotatably connected and on which a first control hydraulic line and a second control hydraulic line are formed;

a first solenoid valve configured to selectively supply hydraulic pressure through the first control hydraulic line;

a second solenoid valve configured to selectively supply hydraulic pressure through the second control hydraulic line;

a position controller configured to selectively change a position of the slider housing according to supplied hydraulic pressure from the first solenoid valve;

a first bridge connected to a second end of the first rocker arm and to which a first valve is connected; and a first valve lift device disposed within the first bridge for changing valve lift of the first valve according to supplied hydraulic pressure from the second control hydraulic line.

2. The variable valve duration/variable valve lift system of claim 1, wherein the position controller comprises:

a controller housing on which a master valve hole is formed; and a master valve inserted into the master valve hole that is moved according to supplied hydraulic pressure from the first solenoid valve so as to change a relative position of the slider housing with respect to the camshaft.

3. The variable valve duration/variable valve lift system of claim 2, wherein:

a lock pin hole is formed to the controller housing, wherein the position controller further comprises:

a lock pin disposed within the lock pin hole and selectively connected to the master valve according to supplied hydraulic pressure from the first solenoid valve; and a return spring disposed within the lock pin hole and elastically supporting the lock pin.

4. The variable valve duration/variable valve lift system of claim 3, wherein a valve groove where the lock pin is selectively inserted into is formed in the master valve.

5. The variable valve duration/variable valve lift system of claim 3, wherein the controller housing is mounted for supporting the rocker shaft.

6. The variable valve duration/variable valve lift system of claim 1, wherein the first valve lift device comprises:

a screw having a screw oil hole connected to the first rocker arm;

a plunger slidable within the first bridge and on which a plunger oil hole in communication with the screw oil hole is formed;

a plunger lock pin slidable within the first bridge and selectively connected to the plunger according to supplied hydraulic pressure from the plunger oil hole;

a plunger return spring disposed within the first bridge and pushing the plunger lock pin to be connected to the plunger;

a lost motion spring disposed within the first bridge and elastically supporting the plunger; and a swivel foot connecting the plunger with the screw.

7. The variable valve duration/variable valve lift system of claim 1, wherein a first slot and a second slot are formed to the inner bracket, and the first cam portion comprises a wheel on which a wheel key is formed and connected to the first cam, and wherein the variable valve duration/variable valve lift system further comprises:

a connecting pin connected to the camshaft;

a first slider pin on which a pin slot is formed, into which the wheel key is slidably inserted along a length direction of the wheel key, and the first slider pin is rotatably inserted into the first slot; and a second slider pin on which a pin hole is formed, into which the connecting pin is slidably inserted along a length direction of the connecting pin, and the second slider pin is rotatably inserted into the second slot.

8. The variable valve duration/variable valve lift system of claim 7, further comprising a bearing disposed between the slider housing and the inner bracket.

9. The variable valve duration/variable valve lift system of claim 7, further comprising a first roller connected to the first end of the first rocker arm and contacting the first cam; and the first bridge connected to the second end of the first rocker arm, wherein the first valve is connected to the first bridge as a pair.

10. The variable valve duration/variable valve lift system of claim 7, further comprising an outer shaft on which a guide slot is formed and to which the camshaft is inserted, and wherein the first cam is connected to the outer shaft.

11. The variable valve duration/variable valve lift system of claim 10, further comprising:

a second cam portion including a second cam connected to the camshaft through the guide slot; and a second rocker arm rotatably connected to the rocker shaft, a first end of which contacts the second cam and a second end of which is connected with a second valve.

12. The variable valve duration/variable valve lift system of claim 11, further comprising:

a second roller connected to the first end of the second rocker arm and contacting the second cam; and a second bridge connected to the second end of the second rocker arm, and wherein the second valve is connected to the second bridge as a pair.

13. The variable valve duration/variable valve lift system of claim 11, further comprising:

a second roller connected to the first end of the second rocker arm and contacting the second cam;

a second bridge connected to the second end of the second rocker arm; and a second valve lift device disposed within a second bridge for changing valve lift of the second valve according to supplied hydraulic pressure from the second control hydraulic line.

14. The variable valve duration/variable valve lift system of claim 13, wherein the second valve lift device comprises:

a screw having a screw oil hole connected to the second rocker arm;

a plunger slidable within the second bridge and on which a plunger oil hole in communication with the screw oil hole is formed;

a plunger lock pin slidable within the second bridge and selectively connected to the plunger according to supplied hydraulic pressure from the plunger oil hole;

a plunger return spring disposed within the second bridge and pushing the plunger lock pin to be connected to the plunger;

a lost motion spring disposed within the second bridge and elastically supporting the plunger; and a swivel foot connecting the plunger with the screw.

15. An engine comprising:

a camshaft;

a first cam portion including a first cam, into which the camshaft is inserted and of which a relative phase angle of the first cam with respect to the camshaft is variable;

an inner bracket transmitting rotation of the camshaft to the first cam portion;

a slider housing in which the inner bracket is rotatably inserted;

a first rocker arm of which a first end contacts the first cam;

a rocker shaft to which the first rocker arm is rotatably connected and on which a first control hydraulic line and a second control hydraulic line are formed;

a first solenoid valve configured to selectively supply hydraulic pressure through the first control hydraulic line;

a second solenoid valve configured to selectively supply hydraulic pressure through the second control hydraulic line;

a position controller configured to selectively change a position of the slider housing according to supplied hydraulic pressure from the first solenoid valve;

a first bridge connected to a second end of the first rocker arm and to which a first valve is connected; and a first valve lift device disposed within the first bridge for changing valve lift of the first valve according to supplied hydraulic pressure from the second control hydraulic line.

16. The engine of claim 15, wherein the first valve lift device comprises:

a screw having a screw oil hole connected to the first rocker arm;

a plunger slidable within the first bridge and on which a plunger oil hole in communication with the screw oil hole is formed;

a plunger lock pin slidable within the first bridge and selectively connected to the plunger according to supplied hydraulic pressure from the plunger oil hole;

a plunger return spring disposed within the first bridge and pushing the plunger lock pin to be connected to the plunger;

a lost motion spring disposed within the first bridge and elastically supporting the plunger; and a swivel foot connecting the plunger with the screw.

17. The engine of claim 15, wherein the position controller comprises:

a controller housing on which a master valve hole is formed; and a master valve inserted into the master valve hole that is moved according to supplied hydraulic pressure from the first solenoid valve so as to change a relative position of the slider housing with respect to the camshaft;

a lock pin disposed within a lock pin hole and selectively connected to the master valve according to supplied hydraulic pressure from the first solenoid valve; and a return spring disposed within the lock pin hole and elastically supporting the lock pin.

18. The engine of claim 17, wherein a first slot and a second slot are formed in the inner bracket, the first cam portion comprises a wheel on which a wheel key is formed and connected to the first cam, and wherein the variable valve duration/variable valve lift system further comprises:

a connecting pin connected to the camshaft;

a first slider pin on which a pin slot is formed, into which the wheel key is slidably along a length direction of the wheel key, and the first slider pin is rotatably inserted into the first slot; and a second slider pin on which a pin hole is formed, into which the connecting pin is slidably inserted along a length direction of the connecting pin, and the second slider pin is rotatably inserted into the second slot.

19. The engine of claim 18, further comprising an outer shaft on which a guide slot is formed and to which the camshaft is inserted, and wherein the first cam is connected to the outer shaft.

20. The engine of claim 19, further comprising:

a second cam portion including a second cam connected to the camshaft through the guide slot; and a second rocker arm rotatably connected to the rocker shaft, a first end of which contacts the second cam and a second end of which is connected with a second valve.

21. The engine of claim 20, further comprising:

a second roller connected to the first end of the second rocker arm and contacting the second cam;

a second bridge connected to the second end of the second rocker arm; and a second valve lift device disposed within the second bridge for changing valve lift of the second valve according to supplied hydraulic pressure from the second control hydraulic line.

22. The engine of claim 21, wherein the second valve lift device comprises:

a screw having a screw oil hole connected to the second rocker arm;

a plunger slidable within the second bridge and on which a plunger oil hole in communication with the screw oil hole is formed;

a plunger lock pin slidable within the second bridge and selectively connected to the plunger according to supplied hydraulic pressure from the plunger oil hole;

a plunger return spring disposed within the second bridge and pushing the plunger lock pin to be connected to the plunger;

a lost motion spring disposed within the second bridge and elastically supporting the plunger; and a swivel foot connecting the plunger with the screw.

* * * * *